United States Patent [19]

Yokota

[11] Patent Number: 4,465,162

[45] Date of Patent: Aug. 14, 1984

[54] ELEVATOR DRIVE APPARATUS USING A TRACTION-TYPE SPEED CHANGE GEAR

[75] Inventor: Satoru Yokota, Ichinomiya, Japan

[73] Assignee: Mitsubishi Denki Kabushiki Kaisha, Tokyo, Japan

[21] Appl. No.: 447,003

[22] Filed: Dec. 6, 1982

[30] Foreign Application Priority Data

Dec. 28, 1981 [JP] Japan ..... 56/211348

[51] Int. Cl.[3] ..... B66B 1/30

[52] U.S. Cl. ..... 187/29 R; 187/20; 318/9; 318/12; 318/14; 310/80; 74/640; 74/750 R

[58] Field of Search ..... 187/29 R, 22, 23, 25, 187/1-20, 26, 27, 44; 318/9-15, 69, 70, 71, 301, 311, 312, 319, 323; 242/85; 310/80; 74/190, 325, 336, 640, 710, 750 R, 785, 788

[56] References Cited

U.S. PATENT DOCUMENTS

| | | | |
|---|---|---|---|
| 2,458,459 | 1/1949 | Wright | 74/750 R |
| 3,128,641 | 4/1964 | Musser | 74/640 |
| 3,187,862 | 6/1965 | Musser | 74/640 X |
| 3,587,350 | 6/1971 | Wanlass | 74/640 X |
| 3,943,780 | 3/1976 | Klaue | 74/750 R X |
| 4,044,274 | 8/1977 | Ohm | 74/640 X |
| 4,072,212 | 2/1978 | Terazono et al. | 187/29 R |
| 4,165,801 | 8/1979 | Watanabe et al. | 187/29 R |
| 4,278,923 | 7/1981 | Nowak et al. | 318/311 X |
| 4,341,982 | 7/1982 | Lahti et al. | 318/110 X |

FOREIGN PATENT DOCUMENTS

| | | | |
|---|---|---|---|
| WO82/01700 | 5/1982 | PCT Int'l Appl. . | |
| 811587 | 4/1959 | United Kingdom . | |
| 2103393 | 2/1983 | United Kingdom | 318/312 |

OTHER PUBLICATIONS

NASA Technical Paper 1378 "Performance of a Nasvytis Multiroller Traction Drive", Nov. '78, Lowenthal et al. p. 22.

*Primary Examiner*—S. J. Witkowski
*Assistant Examiner*—Paul Shik Luen
*Attorney, Agent, or Firm*—Wenderoth, Lind & Ponack

[57] ABSTRACT

A drive apparatus for elevators and the like utilizes a traction-type speed change gear to transmit power with little noise and vibrations from an electric drive motor to the drive sheave of an elevator. An abnormality detection device is provided to detect when slippage occurs in the speed change gear, and a control device activated by the abnormality detection device is provided to bring the elevator to a safe emergency stop when such slippage occurs.

3 Claims, 4 Drawing Figures

ELEVATOR DRIVE APPARATUS USING A TRACTION-TYPE SPEED CHANGE GEAR

BACKGROUND OF THE INVENTION

This invention relates to a drive apparatus equipped with a drive mechanism having a traction-type speed change gear, for use in elevator apparatuses and the like.

Drive apparatuses for elevators are frequently equipped with a drive mechanism having a geared reduction device, with an electric motor connected to the input shaft and a drive sheave connected to the output shaft of the reduction device, and are further equipped with a hoisting rope reeved about the sheave for moving an elevator car. However, geared reduction devices produce considerable noise and vibrations which are transmitted to the building in which the elevator is provided, resulting in a deterioration of the living and working environment in the building. Furthermore, noise and vibrations are transmitted via the hoisting rope to the elevator car, with the result that the passengers within the elevator car are subjected to an unpleasant sensation.

SUMMARY OF THE INVENTION

It is the object of the present invention to provide a drive apparatus which does away with the above-described drawbacks of conventional drive apparatuses, operating silently without vibrations.

It is a further object of the invention to provide a drive apparatus of great safety. These two objects are accomplished by equipping the drive apparatus with a traction-type speed change gear in combination with an abnormality detection device and a control device. The traction-type speed change gear produces smooth, quiet transmission of power from an electric motor to an elevator drive sheave. The abnormality detection device detects when slippage occurs in the speed change gear, and the control device safely brings the elevator to an emergency stop in the event that slippage occurs.

These and other objects of the present invention will become clear upon reading the following description and studying the accompanying drawings.

DESCRIPTION OF THE PREFERRED EMBODIMENTS

Figure 1:
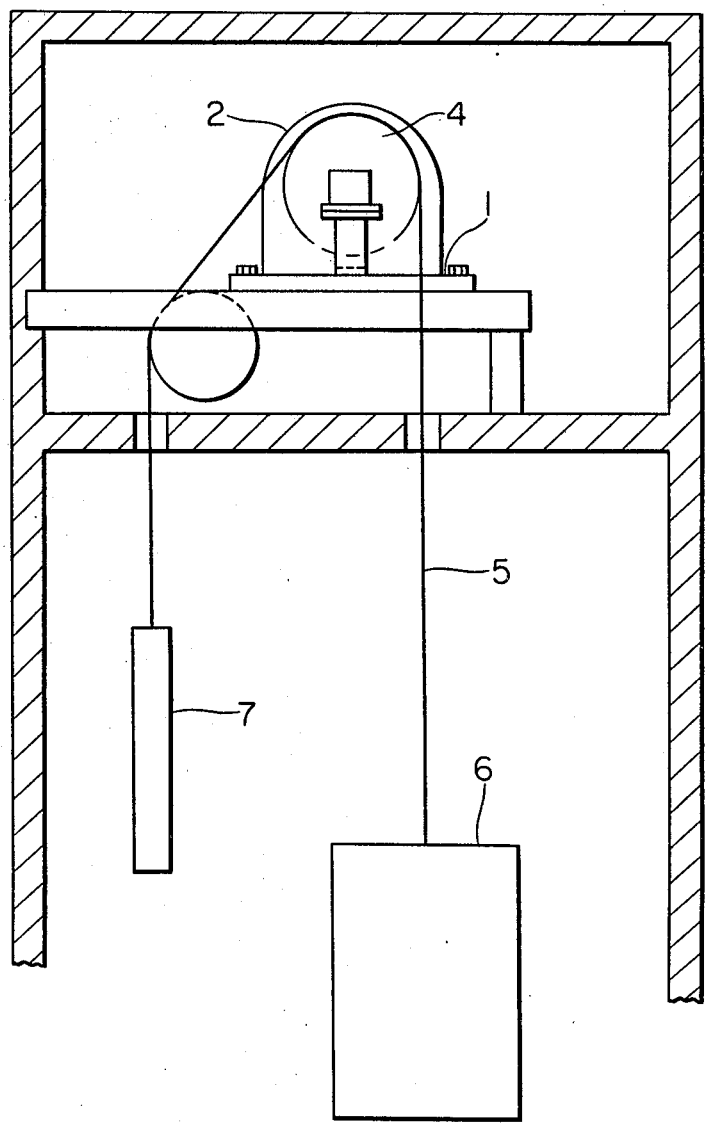
FIG. 1 is a cross-sectional profile of an elevator apparatus showing one embodiment of a driving apparatus according to the present invention.
Figure 2:
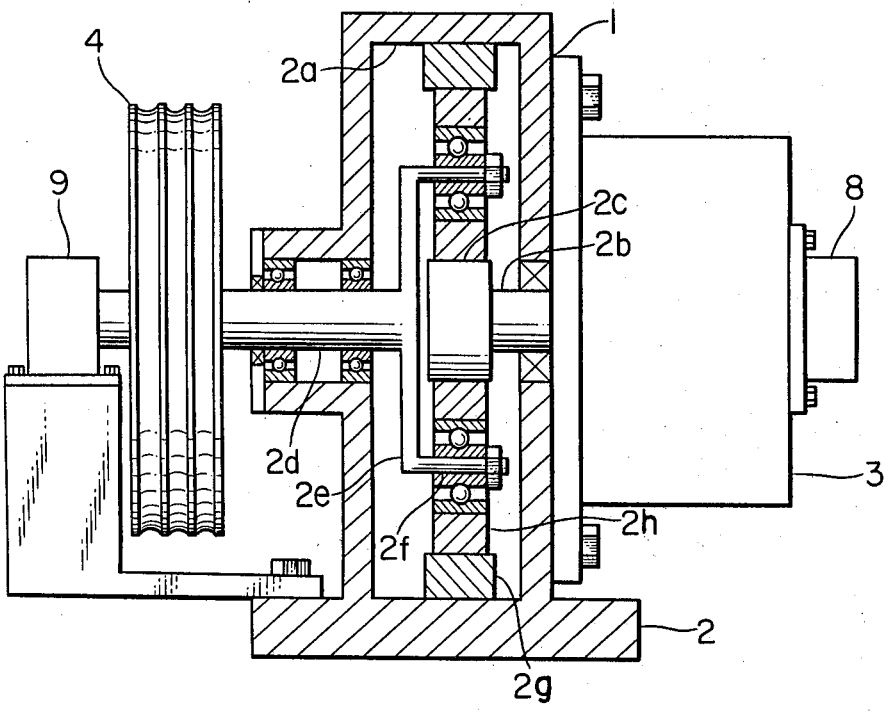
FIG. 2 is a partial cross-section of the apparatus of FIG. 1 as viewed from the right of FIG. 1.
Figure 3:
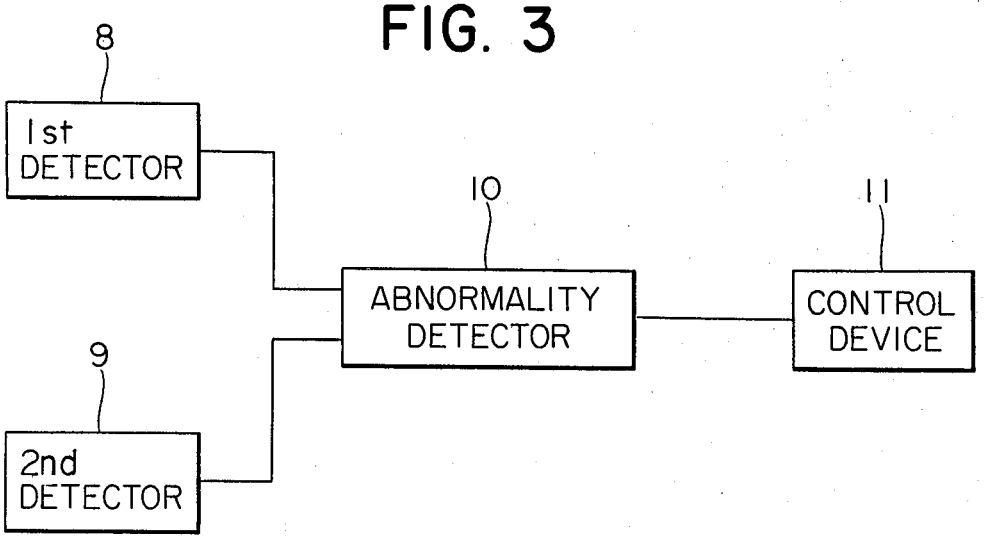
FIG. 3 is a block diagram showing the connection between the abnormality detection and control portions of the driving apparatus of FIG. 1.

Below, one embodiment of the present invention will be described as used in an elevator apparatus, while referring to FIGS. 1 through 4.

In the figures, reference numeral 1 indicates an elevator drive mechanism.

Element 2 is a traction-type speed change gear which forms one of the principal parts of the drive mechanism 1.

Element *2a* is the housing of the speed change gear 2.

Element *2b* is an input shaft which is rotatably mounted in the housing *2a*.

Element *2c* is a first roller which is secured to input shaft *2b* which acts as the sun roller of the speed change gear 2.

Element *2d* is an output shaft which is rotatably mounted in the housing *2a*.

Element *2e* represents support plates which are disposed on one end of the output shaft *2d* and located within the housing *2a*.

Element *2f* represents roller shafts which are rigidly secured at right angles to support plates *2e*, and which are located parallel to and equally separated from the cylindrical surface of the first roller *2c*.

Element *2g* is a frictional body which is secured inside the housing *2a* and having a cylindrical inner surface.

Element *2h* represents second rollers which are rotatably attached to roller shafts *2f* and which are pressed against the cylindrical surface of the first roller *2c* and the inner cylindrical surface of the frictional body *2g*. These second rollers *2h* act as planetary rollers and rotate about the sun roller, first roller *2c*.

Element 3 is an electric motor which is connected to the input shaft *2b*, by means of which the input shaft is rotated.

Element 4 is a drive sheave which is rigidly connected to the output shaft *2d*.

Element 5 is a hoisting rope which is reeved about the drive sheave 4.

Element 6 is an elevator car which is suspended from one end of the hoisting rope 5.

Element 7 is a counterweight which is suspended from the other end of the hoisting rope 5.

Element 8 is a first rotational speed detector of the type well known in the art which measures the rate of rotation of the input shaft *2b* and which produces an output voltage corresponding to this rate.

Element 9 is a second rotational speed detector which is also of the type well known in the art and which detects the rate of rotation of the output shaft *2d* and which produces an output voltage corresponding to this rate.

Element 10 is an abnormality detection device which compares the outputs from the first detector 8 and the second detector 9, and element 11 is a control device which is activated by the abnormality detection device 10 when the latter determines that the difference between the outputs of first detector 8 and second detector 9 falls outside of a predetermined range.

The operation of the drive apparatus is as follows. When electric motor 3 is activated, it rotates input shaft *2b*. This rotation is transmitted to the output shaft *2d* through the action of the first roller *2c*, the frictional body *2g*, and the second rollers *2h*.

Namely, when first roller *2c* is rotated by the input shaft, traction between the various rollers and the frictional body *2g* causes the second rollers *2h*, which act as planetary rollers, to rotate about first roller *2c*, which acts as the sun roller. The rotation of second rollers *2h* is transmitted to the output shaft *2d* by the roller shafts *2f* and the support plates *2e*, and the output shaft is rotated in the same direction as the input shaft but at a slower rate. Thus, the traction-type speed change gear 2 is a reduction gear.

The drive sheave 4 is thereby rotated, and the elevator car 6 and the counterweight 7 are moved by the hoisting rope in mutually opposite directions. The transmission and the change in speed which is carried out by speed change gear 2 consisting of first roller 2c, second roller 2h, etc., is carried out by tractive force, and accordingly, an elevator is obtained which produces little in the way of vibrations and noise.

The traction-type speed change gear 2 can operate only when there is sufficient tractive force between the various rollers and the frictional body. If friction is reduced by abrasion of the rollers, for example, slippage will occur between the rollers of the speed change gear, and transmission of motive force will become difficult or impossible. In the worst case, this slippage could result in the elevator car sliding freely down the elevator shaft as a result of the output shaft 2d rotating independently of the input shaft 2b.

For this reason, first and second rotational speed detectors 8 and 9, abnormality detection device 10, and control device 11 are provided in this drive apparatus. First detector 8 detects the rate of rotation of the input shaft 2b and produces a corresponding voltage. Second detector 9 likewise produces a voltage corresponding to the rate of rotation of the output shaft 2d. As shown conceptually in FIG. 3, these two output voltages are applied to the abnormality detector 10, which compares the voltages. When the difference between the voltages falls outside of a predetermined level, indicating that the input shaft 2b and the output shaft 2d are rotating at disproportionate rates, i.e. that slippage is occurring in the speed change gear 2, the abnormality detection device 10 activates the control device 11. When activated, the control device 11 causes the elevator to make an emergency stop at the nearest floor and issues an alarm.

Figure 4:
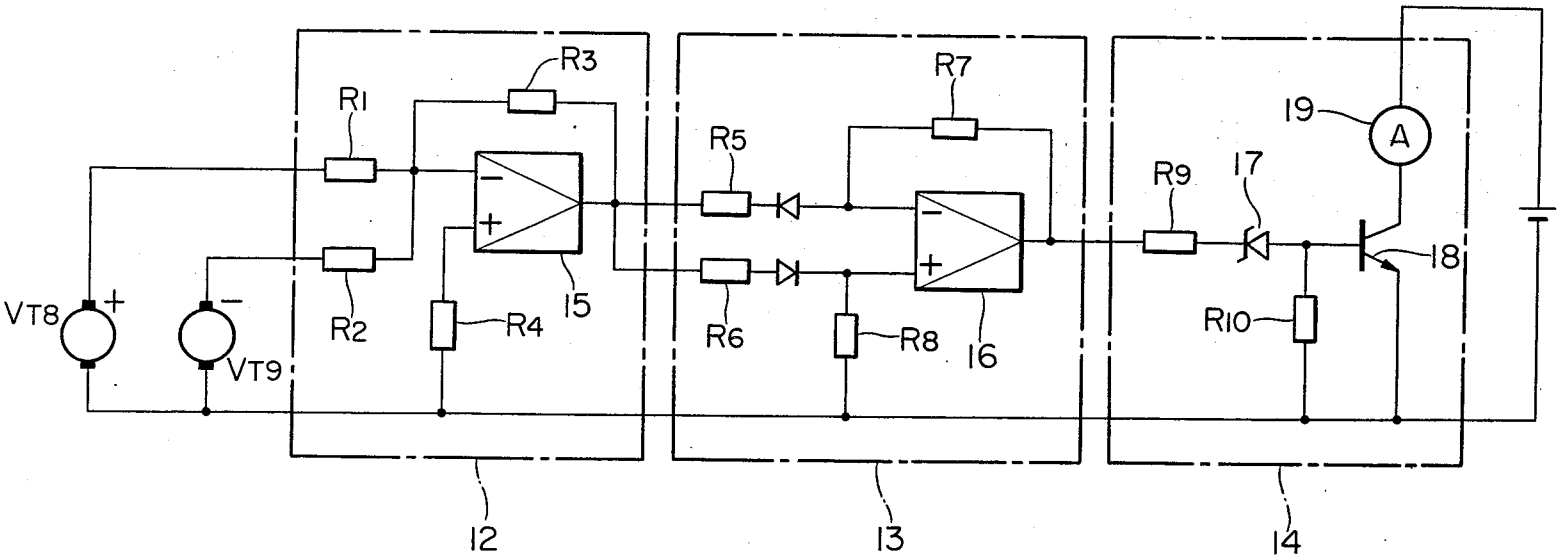
FIG. 4 is a circuit diagram of an abnormality detection device for use the the embodiment illustrated in FIG. 2.

FIG. 4 shows one example of a circuit for an abnormality detection device, consisting of a comparator portion 12, an absolute value production portion 13, and a threshold detection portion 14.

In the figure, $V_{T8}$ is the output voltage of first detector 8, which is proportional to the rotational speed of input shaft 2b and $V_{T9}$ is the output voltage of second detector 9, which is proportional to the rate of rotation of output shaft 2d. $V_{T8}$ and $V_{T9}$ are arranged in the circuit so as to be of opposite polarity. $V_{T8}$ and $V_{T9}$ are applied to the inverting terminal of a first op-amp 15 through resistors $R_1$ and $R_2$. ($R_1$ through $R_{10}$ are all resistors). The output voltage $V_{OUT}$ of first op-amp 15 is $-R_3(V_{T8}/R_1+V_{T9}/R_2)$, and $R_1$ and $R_2$ are chosen so that $V_{OUT}$ is normally 0.

This is possible because, when there is no slippage in the speed change gear, the rotational speed of input shaft 2b is a constant multiple of the rotational speed of output shaft 2d. If the output $V_{T8}$ of first detector 8 is linearly proportional to the speed of the input shaft 2b and if the output $V_{T9}$ of second detector 9 is linearly proportional to the speed of the output shaft 2d, then $V_{T8}$ will be a constant multiple of $V_{T9}$ as long as no slippage occurs.

Thus, $V_{T8}/V_{T9}$ equals a negative constant, $-N$, which is negative since $V_{T8}$ and $V_{T9}$ are of opposite polarity. $R_1$ and $R_2$ are chosen such that $R_1/R_2=-V_{T8}/V_{T9}=-N$, and accordingly $V_{OUT}=-R_3(V_{T8}/R_1+V_{T9}/R_2)$ is 0 when there is no slippage.

However, if slippage occurs in the traction-type speed change gear, the relationship between $V_{T8}$ and $V_{T9}$ will change and $V_{OUT}$ will become non-zero. For example, if the input shaft begins to lag due to slippage, the output $V_{T9}$ of the second detector will decrease in magnitude and $V_{OUT}$ will go negative. Alternatively, if the output shaft begins to slip and rotate freely due to the torque applied on it by the drive sheave 4, the output $V_{T9}$ will increase in absolute value, and $V_{OUT}$ will go positive.

$V_{OUT}$ is applied to the input terminals of a second op-amp 16 and this second op-amp 16 outputs a positive voltage proportional to the absolute value of $V_{OUT}$.

The last part of the circuit is a threshold detection portion 14. When the output of the second op-amp 16 exceeds a predetermined value, corresponding to a certain amount of slippage, the Zener diode 17 begins to conduct, driving the transistor 18, which in turn excites a normally unexcited relay coil 19. When excited, the contact of the relay coil 19 (not shown in the figure) turns on the control device 11, and the elevator is thereby controlled.

By appropriately choosing the resistors, the predetermined value of the second op-amp at which the transistor 18 turns on can be set at any desired level, corresponding to a small or a large amount of slippage in the speed change gear.

The control device 11 is not described here in detail, but may be any device of the type well known in the art which when activated can control an elevator drive mechanism so as to make an emergency stop of the elevator car at the nearest floor and issue an alarm.

The above-described drive apparatus of course has the advantage that it is quieter and produces less vibrations than a drive apparatus using a geared speed change gear, but it also has the advantage that a traction-type speed change gear is cheaper to manufacture.

What is claimed is:

1. A drive apparatus for elevators comprising:

a traction-type speed change gear having an input and an output shaft;

an electric motor connected to said input shaft and disposed so as to rotate said input shaft;

a first detector means for detecting the rate of rotation of said input shaft and for producing an output corresponding to said rate of rotation of said input shaft;

a second detector means for detecting the rate of rotation of said output shaft and for producing an output corresponding to said rate of rotation of said output shaft;

an abnormality detection device which is coupled to said first and second detector means for comparing said outputs of said first and second detector means and for generating an electrical signal when the difference between said outputs falls outside of a predetermined range; and a control means which is coupled to said abnormality detection device and which is responsive to said electrical signal generated by said abnormality detection device for controlling and stopping said drive apparatus.

2. A drive apparatus as claimed in claim 1, wherein said traction-type speed change gear is of the planetary roller type.

3. A drive apparatus as claimed in claim 2, wherein said traction-type speed change gear comprises:

a housing;

a frictional body having a cylindrical inner surface which is secured inside said housing;

a first roller which is rigidly secured to said input shaft and which is contained within said housing;

a roller shaft which is rigidly secured to said output shaft; and a second roller which is rotatably mounted on said roller shaft inside said housing between said first roller and said frictional body so as to be in rolling contact with an outer surface of said first roller and said inner cylindrical surface of said frictional body.

* * * * *